United States Patent [19]

Akashi et al.

[11] 4,188,226

[45] Feb. 12, 1980

[54] DRY IMAGE FORMING MATERIAL CONTAINING DIARYLHALOMETHANE

[75] Inventors: Kageyasu Akashi; Yoshio Hayashi; Tatsumi Arakawa; Takeo Kimura; Hidehiko Kobayashi, all of Fuji, Japan

[73] Assignee: Asahi Kasei Kogyo Kabushiki Kaisha, Osaka, Japan

[21] Appl. No.: 922,463

[22] Filed: Jul. 6, 1978

[30] Foreign Application Priority Data

Jul. 18, 1977 [JP] Japan ..... 52/85109

[51] Int. Cl.[2] ..... G03C 1/02

[52] U.S. Cl. ..... 430/620; 430/349; 430/353

[58] Field of Search ..... 96/141.1, 90 R, 67, 96/76 R, 119 R

[56] References Cited

U.S. PATENT DOCUMENTS

| | | | |
|---|---|---|---|
| 3,152,904 | 10/1964 | Sovensen et al. | 96/76 R |
| 3,457,075 | 7/1969 | Morgan | 96/67 |
| 3,525,616 | 8/1970 | Hackmann et al. | 96/90 R |
| 3,764,329 | 10/1973 | Lee | 96/67 |
| 3,802,888 | 4/1974 | Willits | 96/114.1 |
| 4,002,479 | 1/1977 | Suzuki et al. | 96/114.1 |

*Primary Examiner*—Won H. Louie, Jr.

*Attorney, Agent, or Firm*—Sprung, Felfe, Horn, Lynch & Kramer

[57] ABSTRACT

A dry image forming material comprising:

(a) a non-photosensitive organic silver salt oxidizing agent;

(b) a reducing agent for silver ion; and (c) a compound of the formula,

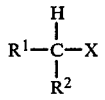

wherein $R^1$ and $R^2$ independently represent an aryl group or a substituted aryl group; and X represents a chlorine atom, a bromine atom or an iodine atom.

7 Claims, No Drawings

DRY IMAGE FORMING MATERIAL CONTAINING DIARYLHALOMETHANE

BACKGROUND OF THE INVENTION

1. Field of the Invention

This invention relates to a dry image forming material. More particularly, it relates to a dry image forming material which has good storage stability, whose sensitivity can be markedly increased by the heat treatment prior to the imagewise exposure to light and which can record images thereon only by dry processing.

2. Description of the Prior Art

Conventional wet processing photosensitive materials require a considerable skill in obtaining good results due to the complicated process of forming images thereon and further a lot of chemicals inconvenient in handling must be used in their processing. For this reason, in order to avoid these disadvantages there have been made many attempts to develop photosensitive materials capable of simplifying image forming process. For example, U.S. Pat. Nos. 3,152,904 and 3,457,075 describe photosensitive materials comprising an organic silver salt oxidizing agent, a reducing agent for silver ion and a catalytic amount of a silver halide which are photosensitive under normal light conditions and which can record images thereon only by dry processing. However, the storage stability of these photosensitive materials are markedly low. U.S. Pat. Nos. 3,802,888 and 3,764,329 describe photosensitive materials which are non-photosensitive under normal light conditions and which can be rendered photosensitive by the preliminary heating prior to the imagewise exposure to light. Although these photosensitive materials have good storage stability and can be advantageously handled under normal light conditions, their sensitivity is much lower than that of the photosensitive materials which are photosensitive under normal light conditions.

SUMMARY OF THE INVENTION

According to the present invention there is provided a dry image forming material comprising:

(a) a non-photosensitive organic silver salt oxidizing agent;

(b) a reducing agent for silver ion; and (c) a compound of the formula,

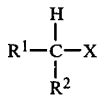

wherein $R^1$ and $R^2$ independently represent an aryl group or a substituted aryl group; and X represents a chlorine atom, a bromine atom or an iodine atom.

DETAILED DESCRIPTION OF THE INVENTION

The non-photosensitive organic silver salt oxidizing agents which can be employed in this invention include silver salts of long chain aliphatic carboxylic acids having 12 to 24 carbon atoms such as silver laurate, silver myristate, silver palmitate, silver stearate, siver arachidate and silver behenate; silver salts of organic compounds having an imino group such as benztriazole silver salt, benzimidazole silver salt, carbazole silver salt and phthalazinone silver salt; silver salts of sulfur containing compounds such as S-alkylthioglycollates; silver salts of aromatic carboxylic acids such as silver benzoate and silver phthalate; silver salt of sulfinic acids such as silver o-toluenesulfinate; silver salts of phosphoric acids such as silver phenylphosphate; silver barbiturate; silver saccharate; silver salts of salicylaldoxime; and any mixtures thereof. Of these compounds, silver salts of long chain aliphatic carboxylic acids having 12 to 24 carbon atoms are preferred.

The amount of the non-photosensitive organic silver salt oxidizing agent which can be employed in this invention typically ranges from about 0.1 $g/m^2$ to about 50 $g/m^2$ of the support area of the dry image forming material. A preferred amount of the non-photosensitive organic silver salt oxidizing agent ranges from about 1 $g/m^2$ to about 10 $g/m^2$ of the support area of the dry image forming material.

The reducing agents for silver ion which can be used in this invention include sterically hindered phenols in which a sterically bulky group is bonded to the carbon atom adjacent to the carbon atom bonded to the hydroxyl group; substituted phenols; hydroquinones; hydroquinone ethers; and other reducing agents for conventional wet processing silver salt type photosensitive materials.

Specific examples of reducing agents for silver ion include 2,6-di-tert-butyl-4-methylphenol, 2,2'-methylenebis(4-methyl-6-tert-butylphenol), 2,6-methylenebis(2-hydroxy-3-tert-butyl-5-methylphenyl)4-methylphenol, 2,2'-methylenebis(4-ethyl-6-tert-butylphenol), 2,4,4-trimethylpentylbis(2-hydroxy-3,5-dimethylphenyl)methane, 2,2'-methylenebis[4-methyl-6-(1-methylcyclohexyl)phenol, 2,5-di-tert-butyl-4-methoxyphenol; p-phenylphenol, p-methoxyphenol, p-aminophenol, catechol, pyrogallol, resorcin, bisphenol A, 2,4-dihydroxybenzoic acid; hydroquinone, methylhydroquinone, chlorohydroquinone, bromohydroquinone, phenylhydroquinone, tert-butylhydroquinone, tert-octylhydroquinone, 2,5-dimethylhydroquinone, 2,6-dimethylhydroquinone, methoxyhydroquinone; hydroquinone monobenzyl ether; $\alpha$-naphthol, $\beta$-naphthol, 1,3-dihydroxynaphthalene, 2,2'-dihydroxy-1,1'-binaphthyl; phenidone, methyl gallate; and any mixtures thereof.

A preferred reducing agent for silver ion can be chosen depending upon the non-photosensitive silver salt oxidizing agent employed. For example, with a non-photosensitive silver salt oxidizing agent such as silver behenate which is relatively hard to be reduced, a relatively strong reducing agent for silver ion such as a sterically hindered phenol including 2,2'-methylenebis(4-ethyl-6-tert-butylphenol) is suitably chosen. On the other hand, with a non-photosensitive silver salt oxidizing agent such as silver laurate which is relatively easy to be reduced, a relatively weak reducing agent for silver ion such as a substituted phenol including p-phenylphenol is suitably chosen, and with a non-photosensitive silver salt oxidizing agent such as silver salt of benztriazole which is very hard to be reduced, a strong reducing agent for silver ion such as ascorbic acid is suitably chosen.

The amount of the reducing agent for silver ion may vary depending upon the non-photosensitive organic silver salt oxidizing agent selected and the reducing agent for silver ion selected. In general, the amount of the reducing agent for silver ion used ranges from about 0.1 percent by weight to about 200 percent by weight based on the weight of the non-photosensitive organic silver salt oxidizing agent. A preferred amount of the reducing agent for silver ion ranges from about 1 percent by weight to about 100 percent by weight.

In the above described formula,

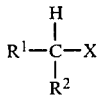

of the compound (c), preferred $R^1$ and $R^2$ independently represent a phenyl group, a naphthyl group, an anthryl group, a phenanthryl group or the group thereof substituted with an alkyl group having 1 to 6 carbon atoms, an alkoxy group having 1 to 4 carbon atoms, a dialkylamino group having 2 to 12 carbon atoms, a phenyl group, a cyano group, a nitro group, a chlorine atom, a bromine atom or an iodine atom. More preferred $R^1$ and $R^2$ independently represent a phenyl group or a phenyl group substituted with the same group as described above. Especially when $R^1$ and $R^2$ are phenyl groups, the solubility of the compounds of the above described formula is superior. With regard to the X in the above described formula, a bromine atom and an iodine atom are preferred from the viewpoint of the sensitivity.

Specific examples of the compounds of the formula,

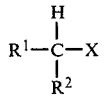

which can be employed in this invention include α-chlorodiphenylmethane, α-bromodiphenylmethane, α-iododiphenylmethane, α-bromodi(p-cyclohexylphenyl)methane, α-chlorodi(p-methoxyphenyl)methane, α-bromodi(p-methoxyphenyl)methane, α-iododi(p-methoxyphenyl)methane, α-chlorodi(o-methoxyphenyl)methane, α-bromo(p-methoxy)(o-methoxy)methane, α-bromodi(p-n-butoxyphenyl)methane, α-chlordi(p-nitrophenyl)methane, α-bromodi(p-nitrophenyl)methane, α-iododi(p-nitrophenyl)methane, α-bromodi(m-nitrophenyl)methane, α-bromo-(p-nitrophenyl)(p-methoxyphenyl)methane, α-bromodi(p-cyanophenyl)methane, α-iododi(p-cyanophenyl)methane, α-bromodi(p-methylphenyl)methane, α-bromodi(o-methylphenyl)methane, α-bromodi(p-n-butylphenyl)methane, α-bromodi(p-chlorophenyl)methane, α-bromodi(p-bromophenyl)methane, α-bromodi(p-phenylphenyl)methane, α-iododi(p-phenylphenyl)methane, α-bromobis[p-(N,N-dimethylamino)-phenyl]-methane, α-bromobis(2,4-dimethoxyphenyl)methane, α-bromobis(2,4-dinitrophenyl)methane, α-bromobis(2,4,6-trimethoxyphenyl)methane, α-bromodi(α-naphthyl)methane and α-bromodi(β-naphthyl)methane and any mixtures thereof.

Of these compounds, α-bromodiphenylmethane is especially preferred from the viewpoint of the sensitivity and solubility.

The amount of the compounds of the above described formula which can be used in this invention may vary depending upon the factors such as the non-photosensitive organic silver salt oxidizing agent chosen, the reducing agent for silver ion selected, the amount of the non-photosensitive organic silver salt oxidizing agent and the reducing agent for silver ion employed and others and typically ranges from about 0.1 percent by weight to about 50 percent by weight based on the weight of the non-photosensitive organic silver oxidizing agent. A preferred amount of the compounds of the above described formula ranges from about 1 percent by weight to about 25 percent by weight based on the weight of the non-photosensitive organic silver salt oxidizing agent.

It may be presumed that the high sensitivity of the dry image forming materials of this invention can be achieved since the compounds (c) exhibit an appropriate reactivity to react with the non-photosensitive organic silver salt oxidizing agent only at the preliminary heating and they are not oxidizing agents.

The dry image forming materials of this invention containing the non-photosensitive organic silver salt oxidizing agent, the reducing agent for silver ion and the compound of the above described formula are non-photosensitive under normal light conditions.

In order to further increase the sensitivity the dry image forming materials of this invention may contain any conventional halogen ion sources for forming photosensitive silver compounds.

Suitable examples of the halogen ion sources which can be employed in this invention include organic haloamides; halogen molecules, metal halides, quaternary ammonium salts, ionizable organic halogen compounds, nonmetallic halogen compounds and halogen-containing organometallic compounds.

Specific examples of the halogen ion sources include N-bromosuccinimide, N-chlorosuccinimide, N-iodosuccinimide, N-bromophthalimide, N-bromoacetamide, N-bromoacetanilide, N-bromophthalazinone, 1-bromo-3,5,5-trimethyl-2,4-imidazolidinedione, 1,3-dibromo-5,5-dimethyl-2,4-imidazolidinedione, N,N-dibromobenzenesulfonamide, N-bromo-N-methylbenzenesulfonamide, 1,3-dibromo-4,4-dimethylhydantoin, potassium salt of dibromoioscyanuric acid, trichloroisocyanuric acid; iodine molecule; calcium iodide, barium iodide, rubidium iodide, cesium iodide, aluminum iodide, magnesium iodide, sodium iodide, potassium iodide, the bromides and the chlorides corresponding to the above described iodides; tetraethylammonium salts, benzyltrimethylammonium salts or phenyltrimethylammonium salts of hydroiodic acid, hydrobromic acid and hydrochloric acid; triphenylmethyl iodide, phenacyl bromide; triphenylphosphine diiodide, triphenylphosphine dibromide, triphenylphosphite diiodide, triphenylphosphite dirbromide; titanocene dichloride, zirconocene dichloride, dimethylsilyl dichloride, trimethylsilyl chloride, triphenylgermanium bromide and any mixtures thereof.

The amount of the halogen ion source used typically ranges from about 50 percent by mole to about 0.1 percent by mole and preferably from about 10 percent by mole to about 1 percent by mole based on the mole of the non-photosensitive organic silver salt oxidizing agent.

When the dry image forming materials of this invention contain the organic haloamides, they become non-photosensitive under normal conditions. On the other hand, when the dry image forming materials contain the metal halide or the quaternary ammonium salt, the dry image forming materials become photosensitive under normal light conditions.

Furthermore, the dry image forming materials of this invention may contain a photosensitive silver compound including silver chloride, silver bromide, silver iodide and any mixtures thereof. These photosensitive compounds may be prepared separately and then incorporated with the dry image forming materials. The amount of the photosensitive silver compounds used preferably ranges from about 0.1 percent by weight to about 40 percent by weight based on the weight of the non-photosensitive silver salt oxidizing agent.

In both cases, the dry image forming materials of this invention have good storage stability prior to the preliminary heating and their sensitivity can be markedly increased by the preliminary heating prior to the imagewise exposure to light.

The dry image forming materials of this invention can be practically used without addition of an anti-foggant thereto. However, if a higher anti-fogging effect is desired, an appropriate anti-foggant may be employed in this invention.

Suitable anti-foggants which can be used include mercury salts, palladium salts, benztriazoles, phenylmercaptotetrazoles, carboxylic acid anhydrides such as chlorendic anhydride, trimellitic anhydride, phthalic anhydride, camphoric anhydride, cyclohexanedicarboxylic anhydride, succinic anhydride, tetrabromophthalic anhydride and tetrachlorophthalic anhydride and various acidic compounds and any mixtures thereof. For example, when mercuric acetate is used as the anti-foggant agent in an amount as small as about 0.01 mole percent based on the amount of the non-photosensitive organic silver salt oxidizing employed, the dry image forming materials of this invention can exhibit a remarkable anti-fogging effect. Also, when the carboxylic anhydrides are used in an amount of from about 0.05 to about 10 mole percent based on the amount of the non-photosensitive organic silver salt oxidizing agent, a remarkable anti-fogging effect can be given the dry image forming materials of this invention.

In addition to the above described additives, if necessary or if desired, the dry image forming materials of this invention may contain modifiers such as a film forming binder, a toner for silver images, a photosensitizer and a background-darkening preventive agent.

In many cases the film forming binder is required for shaping the dry image forming materials of this invention into a film. However, the non-photosensitive organic silver salt oxidizing agent and/or the reducing agent act as the film forming binder, use of a film forming binder can be omitted. Exemplary film forming binders which can be used in this invention include polyvinyl acetates, vinyl chloride-vinyl acetate copolymers, polyvinyl chlorides, polyvinyl butyrals, polymethyl methacrylates, cellulose acetates, cellulose acetate propionates, cellulose acetate butyrates, polyvinyl alcohols, polyvinyl pyrrolidones, gelatin, polystyrenes and any mixtures thereof. The film forming binder can be used generally in such an amount that the weight ratio of the film forming binder to the non-photosensitive organic silver salt oxidizing agent ranges from about 0.1 to about 10.

Exemplary toners for silver images which can be used in this invention include phthalazinone, benzoxazidinedione, cyclic imides such as succinimide, quinazolinone, 2-pyrazoline-5-one, zinc acetate, cadmium acetate and any mixtures thereof. The amount of the toner for silver image typically ranges from about 0.01 percent by mole to about 1 percent by mole based on the mole of the non-photosensitive organic silver oxidizing agent.

Suitable photosensitizers include amides such as 1-methyl-2-pyrrolidinone, 1-methylpiperidone, N,N-dimethylnicotinamide and N-acetylmorpholine and the amount of the photosensitizers used typically ranges from about 0.01 percent by mole to about 5 percent by mole based on the mole of the non-photosensitive organic silver salt oxidizing agent.

Exemplary background-darkening preventive agents which can be used in this invention include 1,2,3,4-tetrabromobutane, 1,2,3,4,5,6-hexabromocyclohexane, tribromomethylquinoline and any mixtures thereof. The amount of the background-darkening preventive agents used typically ranges from about 2.5 percent by mole to about 14 percent by mole based on the mole of the non-photosensitive organic silver oxidizing agent.

For example, a dry image forming material of this invention may be prepared by dispersing a non-photosensitive organic silver salt oxidizing agent prepared separately into a binder solution or a binder emulsion by a sand grinder, a mixer or a ball mill, mixing other components of this invention and, if necessary or if desired, other additives with the resulting emulsion to give a composition, coating the composition thus prepared on a support by a conventional method to form a layer of the dry image forming material and dyring the layer of the dry image forming material. Exemplary supports which can be used in this invention include plastic films such as cellulose acetate films, polyester films, polyamide films, polyimide films, polyvinyl acetal films, polystyrene films, polyethylene films and polycarbonate films; glass plates; papers such as photographic base paper, coated paper, art paper, barite paper, waterproof paper and ordinary paper; and metal plates such as aluminum plates. The thickness of the layer of the dry image forming material dried typically ranges from about $1\mu$ to about $1000\mu$. A preferred thickness of the layer of the dry image forming material dried ranges from about $3\mu$ to $20\mu$. Also, the components of the composition of the dry image forming material may be coated on a support in a plurality of layers in any combinations.

The dry image forming materials of this invention can be increased in their sensitivity by the preliminary heating prior to the imagewise exposure to light. The temperature of the preliminary heating which can be employed in this invention typically ranges from about 90° C. to about 200° C. and the period of time of the preliminary heating varies depending upon the temperature of the preliminary heating employed and becomes shorter with increased temperatures. In general, the period of time of preliminary heating ranges from about 1 second to about 60 seconds. Then, the dry image forming materials which sensitivity has been increased by the preliminary heating are subjected to the imagewise exposure to light and subsequently to the heat development, resulting in visible images.

Exemplary light sources which can be employed in the imagewise exposure include tungsten lamps, fluorescent lamps, xenon lamps, mercury lamps, iodine lamps and CRT light sources. Exemplary methods of the imagewise exposure to light include photographing with a camera, projective exposure and contact exposure by placing a manuscript on the image forming material. The period of time of the imagewise exposure to light varies depending upon the light source selected and typically ranges from about one hundredth of second to about 10 seconds.

The temperature of the heat development which can be used typically ranges from about 90° C. to about 200° C. and the period of time of the heat development varies depending upon the temperature of the heat development selected and typically ranges from about 1 second to about 60 seconds. When the preliminary heating and the heat development are conducted at the same temperature, the period of time of the heat development is generally longer than that of the preliminary heating. The preliminary heating and the heat development may be conducted using a hot plate, a hot roll, hot air, far infrared rays and high frequency induction heating.

The present invention will now be illustrated in more detail by the following non-limiting examples.

EXAMPLE 1

To 20 parts by weight of a mixed liquid of methyl ethyl ketone and toluene in a weight ratio of 2 to 1 was added 4 parts of silver behenate, and the mixture was ball-milled for about 24 hours to give a homogeneous silver behenate suspension.

To 6.0 g of the silver behenate suspension was added each of the ingredients of Composition I as set forth below in the order described therein and the mixture was thoroughly mixed with stirring, coated on the polyester film as the first layer and dried.

| Composition I | |
|---|---|
| Polyvinyl butyral | 0.72 g |
| Methyl ethyl ketone | 4.0 g |
| Mercuric acetate (0.25 percent by weight methanol solution) | 0.6 ml |
| 1,2,3,4-Tetrabromobutane | 0.09 g |
| Compound of the formula, $R^1-\overset{\overset{H}{\vert}}{\underset{\underset{R^2}{\vert}}{C}}-X$ as shown in Table I | one tenth equivalent of silver behenate |

Then, a mixture of the ingredients of Composition II as set forth below was coated, as the second layer, on the first layer and dried.

| Composition II | |
|---|---|
| Cellulose acetate | 0.63 g |
| Acetone | 8.3 g |
| Phthalazinone | 0.14 g |
| 2,2'-Methylenebis(6-tert-butyl-4-ethylphenol) | 0.35 g |

All the procedures for preparing these image forming materials were carried out in a light room.

Each of the image forming materials thus prepared was heated at 100° C. for 5 seconds in a dark room, exposed to light from a 500 watt xenon lamp through a mask film for one tenth of second and subsequently heated at 120° C. for 5 seconds to develop a negative image.

The maximum optical density and the minimum optical density of the image formed are shown in Table I.

Further, each of the image forming materials as described above was firstly exposed to light in a xenon fadeometer ("Fadeometer XF-1", manufactured by Suga Shikenki Co., Ltd.) for 2 hours to test its storage stability and secondly subjected to the same procedures as described above to form an image. The maximum optical density and the minimum optical density of the image are also shown in Table I.

EXAMPLE 2

To 6.0 g of the same silver behenate suspension was added each of the ingredients of Composition III as set forth below in the order described and the mixture was thoroughly mixed with stirring, coated on a glass plate as the first layer and dried.

| Composition III | |
|---|---|
| Polyvinyl butyral | 0.72 g |
| Methyl ethyl ketone | 4.0 g |
| Mercuric acetate (0.25 percent by weight methanol solution) | 0.6 ml |
| 1,2,3,4-Tetrabromobutane | 0.09 g |
| Triphenyl phosphite | 0.04 g |
| Iodine | 0.04 g |
| Compound of the formula $R^1-\overset{\overset{H}{\vert}}{\underset{\underset{R^2}{\vert}}{C}}-X$ as shown in Table II | one tenth equivalent of silver behenate |

Then, a mixture of the ingredients of Composition IV as set forth below was coated, as the second layer, on the first layer and dried.

| Composition IV | |
|---|---|
| Cellulose acetate butyrate | 0.63 g |
| Acetone | 8.3 g |
| Phthalazinone | 0.14 g |
| 2,2'-Methylenebis(6-tert-butyl-4-ethylphenol) | 0.35 g |

All the procedures of preparing these image forming materials were carried out in a light room.

Each of the image forming materials thus prepared was heated at 100° C. for 5 seconds in a dark room, exposed to light from a 500 watt xenon lamp through a mask film for one hundred of second and subsequently heated at 120° C. for 5 seconds to develop a negative image.

The maximum optical density and the minimum optical density of the image formed are shown in Table II.

Further, each of the image forming materials as described above was firstly subjected to the same stability test as in Example 1 and secondly subjected to the same procedures as described above to form an image. The maximum optical density and the minimum optical density of the image are also shown in Table II.

EXAMPLE 3

To 20 parts by weight of a mixed liquid of methyl ethyl ketone and toluene in a weight ratio of 2 to 1 was added 6 parts by weight of silver behenate, and the mixture was ball-milled for about 8 hours to give a homogeneous silver behenate suspension.

To 3.0 g of the silver behenate suspension was added each of the ingredients of Composition V as set forth below in the order described and the mixture was thoroughly mixed with stirring, coated on a polyester film and dried at 90° C. under heating. The mixing, coating and drying procedures were all carried out in a dark room.

| Composition V | |
|---|---|
| Silver behenate suspension | 3.0 g |
| Polyvinyl butyral | 0.36 g |
| Methyl ethyl ketone | 2.0 g |
| Mercuric acetate (0.25 percent by weight methanol solution) | 0.3 ml |
| 1,2,3,4,5,6-Hexabromocyclohexane | 0.03 g |
| Tetraethylammonium iodide | 0.01 g |
| Compound of the formula $R^1-\overset{H}{\underset{R^2}{C}}-X$ as shown in Table III | one tenth equivalent of silver behenate |
| Phthalazinone | 0.07 g |
| 2,2'-Methylenebis(6-tert-butyl-4-ethylphenol) | 0.35 g |

Each of the image forming materials thus prepared was exposed to light from a 500 watt xenon lamp from a mask film for one tenth of second and subsequently heated at 130° C. for 1 minute to develop a negative image.

The maximum optical density and the minimum optical density of the image formed are shown in Table III.

EXAMPLE 4

To 20 parts by weight of a mixed liquid of methyl ethyl ketone and toluene in a weight ratio of 2 to 1 was added 6 parts by weight of silver stearate, and the mixture was ball-milled for about 8 hours to give a homogeneous silver stearate suspension.

To 3.0 g of the silver stearate suspension was added each of the ingredients of Composition VI as set forth below in the order described therein and the mixture was thoroughly mixed with stirring, coated on a polyester film as the first layer and dried.

| Composition VI | |
|---|---|
| Polyvinyl butyral | 0.36 g |
| Methyl ethyl ketone | 2.0 g |
| Mercuric acetate (0.25 percent by weight methanol solution) | 0.3 ml |
| 1,2,3,4-Tetrabromobutane | 0.03 g |
| Compound $R^1-\overset{H}{\underset{R^2}{C}}-X$ as shown in Table IV | one tenth equivalent of silver stearate |
| 1-Methyl-2-pyrrolidinone | 0.05 g |

Then, a mixture of the ingredients of Composition VII as set forth below was coated, as the second layer, on the first layer and dried.

| Composition VII | |
|---|---|
| Polymethyl methacrylate | 0.5 g |
| Acetone | 8.0 g |
| Succinimide | 0.16 g |
| 2,6-Methylenebis(2-hydroxy-3-tert-butyl-5-methylphenyl)-4-methylphenol | 0.3 g |

All the procedures for preparing these image forming materials were carried out in a light room.

Each of the image forming materials thus prepared was heated at 100° C. for 3 seconds in a dark room, exposed to light from a 500 watt tungsten lamp through a mask film for one fifth of second and subsequently heated at 130° C. for 2 seconds to develop a negative image. The maximum optical density and the minmum optical density of the image are shown in Table IV.

EXAMPLE 5

To 20 parts by weight of a mixed liquid of methyl ethyl ketone and toluene in a weight ratio of 2 to 1 was added 6 parts by weight of benztriazole silver salt, and the mixture was ball milled for about 8 hours to give a homogeneous benztriazole silver salt suspension.

To 3.0 g of the benztriazole silver salt suspension was added each of the ingredients of Composition VIII as set forth below in the order described therein and the mixture was thoroughly mixed with stirring, coated on an art paper and dried.

| Composition VIII | |
|---|---|
| Polyvinyl butyral | 0.25 g |
| Methyl ethyl ketone | 2.0 g |
| Mercuric acetate (0.25 percent by weight methanol solution) | 0.3 ml |
| 1,2,3,4-Tetrabromobutane | 0.03 g |
| N-Bromosuccinimide | 0.01 g |
| Compond $R^1-\overset{H}{\underset{R^2}{C}}-X$ as shown in below* | one twentieth equivalent of benztriazole silver salt |
| t-Butylhydroquinone | 0.20 g |
| Phthalazinone | 0.05 g |

*α-Bromodiphenylmethane
α-Bromodi(p-nitrophenyl)methane
α-Bromodi(m-nitrophenyl)methane
α-Bromodi(p-n-butoxyphenyl)methane
α-Bromobis[p-(N,N-dimethylamino)phenyl]methane All the procedures for preparing these image forming materials were carried out in a light room.

Each of the image forming materials thus prepared was heated at 110° C. for 1 second using a heat roll in a dark room, exposed to light from a 1 KW xenon lamp through a mask film for one tenth of second and subsequently heated at 120° C. for 3 seconds to develop a negative image. All the images formed were clear but when the compounds of the formula $$R^1-\overset{H}{\underset{R^2}{C}}-X$$

as described above were not employed, the image formed was somehow observed.

Table I

| Compound: $R^1-\overset{H}{\underset{R^2}{C}}-X$ | Optical Density of Image | | | |
|---|---|---|---|---|
| | Maximum | Minimum | Maximum* | Minimum* |
| α-Bromodiphenylmethane | 2.06 | 0.06 | 2.10 | 0.07 |
| α-Iododiphenylmethane | 1.53 | 0.08 | 1.66 | 0.07 |
| α-Bromo(p-methoxyphenyl)methane | 2.58 | 0.09 | 2.22 | 0.09 |
| α-Bromodi(p-nitrophenyl)methane | 1.99 | 0.08 | 1.84 | 0.07 |
| Calcium bromide** | 0.57 | 0.35 | 0.60 | 0.56 |

*Image formed after the stability test by a fadeometer
**Comparative Example

Table II

| Compound: $R^1-\overset{H}{\underset{R^2}{C}}-X$ | Optical Density of Image | | | |
|---|---|---|---|---|
| | Maximum | Minimum | Maximum* | Minimum* |
| α-Bromodiphenylmethane | 2.03 | 0.07 | 2.11 | 0.07 |
| α-Chlorodiphenylmethane | 1.68 | 0.05 | 1.72 | 0.06 |
| α-Bromo(p-nitrophenyl)p-methoxy-phenyl)methane | 2.90 | 0.07 | 2.72 | 0.07 |
| α-Bromodi(α-naphthyl)methane | 2.33 | 0.07 | 2.35 | 0.08 |
| α-Bromodi(p-methylphenyl)-methane | 2.01 | 0.07 | 2.16 | 0.07 |
| None** | 0.33 | 0.08 | 0.46 | 0.28 |

*Image formed after the stability test by a fadeometer
**Comparative Example

Table III

| Compound: $R^1-\overset{H}{\underset{R^2}{C}}-X$ | Optical Density of Image | |
|---|---|---|
| | Maximum | Minimum |
| α-Bromodiphenylmethane | 2.35 | 0.07 |
| α-Chlorodiphenylmethane | 2.01 | 0.07 |
| Cobalt bromide* | 0.42 | 0.11 |
| Tetraethylammonium bromide* | 0.52 | 0.05 |
| Hydrogen bromide* | 0.36 | 0.06 |
| None* | 0.11 | 0.06 |

*Comparative Examples

Table IV

| Compound: $R^1-\overset{H}{\underset{R^2}{C}}-X$ | Optical Density of Image | |
|---|---|---|
| | Maximum | Minimum |
| α-Bromodi(p-cyanophenyl)methane | 1.52 | 0.09 |
| α-Bromodi(o-methylphenyl)methane | 1.46 | 0.09 |
| α-Bromodi(m-nitrophenyl)methane | 1.55 | 0.10 |
| α-Bromodi(p-phenylphenyl)methane | 1.37 | 0.09 |
| α-Bromodi(p-bromophenyl)methane | 1.60 | 0.08 |
| α-Bromodiphenylmethane | 2.23 | 0.06 |

What is claimed is:

1. A dry image forming material comprising:
(a) a non-photosensitive organic silver oxidizing agent;
(b) a reducing agent for silver ion; and
(c) a compound of the formula, $$R^1-\overset{H}{\underset{R^2}{C}}-X$$

wherein $R^1$ and $R^2$ independently represent an aryl group or a substituted aryl group; and X represents a chlorine atom, a bromine atom or an iodine atom.

2. The dry image forming material as claimed in claim 1, wherein the $R^1$ and the $R^2$ of the compound (c) independently represent a phenyl group, a naphthyl group, an anthryl group, a phenanthryl group or the group thereof substituted with an alkyl group having 1 to 6 carbon atoms, an alkoxy group having 1 to 4 carbon atoms, a dialkylamino group having 2 to 12 carbon atoms, a phenyl group, a cyano group, a nitro group, a chlorine atom, a bromine atom or an iodine atom; and the X of the compound (c) represents a chlorine atom, a bromine atom or an iodine atom.

3. The dry image forming material as claimed in claim 2, wherein the $R^1$ and the $R^2$ of the compound (c) independently represent a phenyl group or a phenyl group substituted with an alkyl group having 1 to 6 carbon atoms, an alkoxy group having 1 to 4 carbon atoms, a dialkylamino group having 2 to 12 carbon atoms, a phenyl group, a cyano group, a nitro group, a chlorine atom, a bromine atom or an iodine atom; and the X of the compound (c) represents a chlorine atom, a bromine atom or an iodine atom.

4. The dry image forming material as claimed in claim 3, wherein the compound (c) is α-bromodiphenylmethane.

5. The dry image forming material as claimed in claim 1, wherein the amount of the compound (c) based on the weight of the non-photosensitive organic silver salt oxidizing agent ranges from about 0.1 percent by weight to about 50 percent by weight.

6. The dry image forming material as claimed in claim 5, wherein the amount of the compound (c) based on the weight of the non-photosensitive organic silver salt oxidizing agent ranges from about 1 percent by weight to about 25 percent by weight.

7. The dry image forming material as claimed in claim 1, wherein the non-photosensitive organic silver salt oxidizing agent is a silver salt of a long chain aliphatic carboxylic acid having 12 to 24 carbon atoms.

* * * * *